US009790889B2

(12) United States Patent
Beerens et al.

(10) Patent No.: US 9,790,889 B2
(45) Date of Patent: Oct. 17, 2017

(54) PISTON

(71) Applicant: Mahle International GmbH, Stuttgart (DE)

(72) Inventors: Christoph Beerens, Stuttgart (DE); Dieter Emmrich, Waiblingen (DE); Christoph Luven, Stuttgart (DE); Uwe Mohr, Stuttgart (DE); Reinhard Rose, Stuttgart (DE)

(73) Assignee: Mahle International GmbH, Stuttgart (DE)

( * ) Notice: Subject to any disclaimer, the term of this patent is extended or adjusted under 35 U.S.C. 154(b) by 128 days.

(21) Appl. No.: 14/352,935

(22) PCT Filed: Oct. 16, 2012

(86) PCT No.: PCT/EP2012/070448

§ 371 (c)(1),
(2) Date: Apr. 18, 2014

(87) PCT Pub. No.: WO2013/057080

PCT Pub. Date: Apr. 25, 2013

(65) Prior Publication Data

US 2014/0251255 A1 Sep. 11, 2014

(30) Foreign Application Priority Data

Oct. 21, 2011 (DE) ..... 10 2011 084 992
Jul. 2, 2012 (DE) ..... 10 2012 211 440

(51) Int. Cl.
*F02F 3/10* (2006.01)
*C23C 4/02* (2006.01)
(Continued)

(52) U.S. Cl.
CPC ..... *F02F 3/10* (2013.01); *C23C 4/02* (2013.01); *C23C 4/08* (2013.01); *C23C 4/123* (2016.01);
(Continued)

(58) Field of Classification Search
CPC .... F02F 3/10; F02F 3/105; C23C 4/02; C23C 4/04; C23C 4/06; C23C 4/08
See application file for complete search history.

(56) References Cited

U.S. PATENT DOCUMENTS 309,537 A 12/1884 Gillette
2,715,259 A * 8/1955 Mohler ..... B32B 15/012 428/647
(Continued)

FOREIGN PATENT DOCUMENTS

CH 653099 A5 12/1985
DE 1775349 U 10/1958
(Continued)

OTHER PUBLICATIONS

DSM Manufacturing Compnay, Plating Specification—General Information, https://web.archive.org/web/20091014060847/http://dsmmfg.com/Documents/PlatingRef.pdf, Oct. 2009, p. 21.*
(Continued)

*Primary Examiner* — Kevin Lathers
(74) *Attorney, Agent, or Firm* — Fishman Stewart PLLC

(57) ABSTRACT

A piston for an internal combustion engine may include a surface in a region on a crankshaft side. The piston may include a thermally conductive coating disposed on the surface via thermal spraying.

17 Claims, 1 Drawing Sheet

(51) Int. Cl.

| | |
|---|---|
| ***C23C 4/08*** | (2016.01) |
| ***C23C 24/04*** | (2006.01) |
| ***C23C 28/02*** | (2006.01) |
| ***C23C 4/123*** | (2016.01) |
| ***C23C 4/134*** | (2016.01) |

(52) U.S. Cl.

CPC ..... *C23C 4/134* (2016.01); *C23C 24/04* (2013.01); *C23C 28/023* (2013.01); *F05C 2251/048* (2013.01)

(56) References Cited

U.S. PATENT DOCUMENTS

| | | | | |
|---|---|---|---|---|
| 3,552,370 | A | 1/1971 | Briggs | |
| 3,583,290 | A * | 6/1971 | Briggs et al. | 92/158 |
| 4,368,697 | A * | 1/1983 | Moebus | 123/41.35 |
| 6,532,913 | B1 | 3/2003 | Opris | |
| 6,840,156 | B1 | 1/2005 | Gillman et al. | |
| 7,892,609 | B2 | 2/2011 | Mueller | |
| 8,993,048 | B2 * | 3/2015 | Arndt | B05D 1/12 427/190 |
| 2002/0073982 | A1 * | 6/2002 | Shaikh | C23C 24/04 123/688 |
| 2007/0113802 | A1 | 5/2007 | Mihara | |
| 2007/0218303 | A1 | 9/2007 | Ogawa et al. | |

FOREIGN PATENT DOCUMENTS

| | | | |
|---|---|---|---|
| DE | 2007891 | A1 | 9/1970 |
| DE | 102004025960 | A1 | 1/2005 |
| DE | 102006057839 | A1 | 6/2008 |
| EP | 0035290 | A1 | 9/1981 |
| EP | 2096290 | A1 | 9/2009 |
| EP | 2495412 | A1 | 9/2012 |
| FR | 2883334 | A1 | 9/2006 |
| GB | 309537 | | 4/1930 |
| GB | 732944 | A | 6/1955 |
| GB | 2075147 | A | 3/1981 |
| JP | S61-129817 | | 3/1988 |
| JP | H08-232758 | A | 9/1996 |
| JP | 2005-029858 | A | 2/2005 |
| JP | 2006-132001 | A | 5/2006 |

OTHER PUBLICATIONS

English abstract for FR-2883334.
English abstract for DE-102006057839.
German Search Report for DE102012211440.8 dated Mar. 15, 2013.
English abstract for JP-H08-232758.
English translation of JP Office Action for JP2014-536199, dated Jan. 17, 2017.
English abstract for JP-2005-029858.
English translation of JP Office Action for JP2014-536199, dated Jun. 7, 2016.

* cited by examiner

PISTON

CROSS-REFERENCE TO RELATED APPLICATIONS

This application claims priority to German Patent Application No. 10 2011 084 992.0, filed Oct. 21, 2011, German Patent Application No. 10 2012 211 440.8, filed Jul. 2, 2012, and International Patent Application No. PCT/EP2012/070448, filed Oct. 16, 2012, all of which are hereby incorporated by reference in their entirety.

TECHNICAL FIELD

The present invention relates to a piston for an internal combustion engine according to the introductory clause of Claim 1.

BACKGROUND

From EP 0 035 290 A1 a generic piston for an internal combustion engine is known, having an upper part consisting of ferrous material and a lower part connected therewith via conventional means, wherein there is situated on the underside of the upper part a ring resting on the corresponding surface of the lower part, which ring encloses both the radial inner boundary of the cooling duct, which is open to the connecting plane, in the upper part, and also a central cooling chamber in the upper part, connected with the cooling duct via radially arranged coolant bores and open to the connecting plane. In order to be able to bring about an improvement to the cooling effect in the hottest regions of the upper part, and an equalizing of the temperature distribution in the ring area, the upper wall region of the cooling duct is coated with a highly thermally conductive material.

Modern pistons are usually cooled for reaching high engine performances and have here a substantially ring-shaped cooling duct running between a piston upper part and a piston lower part. In order to be able to discharge the thermal energy occurring in the combustion chamber, the heat occurring in the piston upper part is discharged via the cooling fluid, for example oil, flowing in the cooling duct. However, the heat distribution here is very variable in the region of the upper part, whereby not only do thermal stresses occur within the piston, but also an optimum heat removal through the cooling fluid flowing in the cooling duct is at least made difficult.

SUMMARY

The present invention is therefore concerned with the problem of indicating for a piston of the generic type an improved or at least an alternative embodiment, which is distinguished in particular by an improved heat removal.

This problem is solved according to the invention by the subject matter of the independent Claim 1. Advantageous embodiments are the subject matter of the dependent claims.

The present invention is based on the general idea of providing a region of a piston, on the crankshaft side, of an internal combustion engine with a thermally conductive coating that is sprayed on by means of a thermal spraying method. By means of the thermal spraying, in particular by means, for example, of cold gas spraying, a comparatively high process speed and thereby an economically advantageous implementation within a production line can be made possible. With the thermally conductive coating according to the invention in addition a uniform temperature distribution can be achieved within the piston, in particular within a piston upper part facing a combustion chamber, and furthermore so-called local "hot spots" can be avoided. When such a thermally conductive coating is arranged for example in the region of a cooling duct running in the piston, also a targeted heat dissipation can be achieved towards the cooling medium of the cooling duct and thereby an improved cooling of the piston per se. Through the improved cooling of the piston, in particular also a coking of lubricating oil can be avoided or at least the risk of such a coking can be reduced. By the cold gas spraying in particular also an almost pore-free coating can be produced.

In an advantageous further development of the solution according to the invention, the thermally conductive coating is applied by means of cold gas spraying onto the region of the piston on the crankshaft side. Owing to the comparatively high kinetic energy of the particles striking onto the surface which is to be coated, these are "interlocked" with their substrate (carrier material), so that the thermally conductive coating adheres extremely strongly to the surface which is to be coated. The thermally conductive coating can, moreover, be oxide-free and very compact. The piston itself is not heated during the coating process and consequently also does not expand. All this has a positive effect on the thermal and mechanical stability of the piston according to the invention, wherein this thermal and mechanical stability can be additionally positively influenced by materials in the thermally conductive coating. Particularly copper and silver have here a high thermal conductivity and therefore have a particularly positive effect on the thermal stability. Generally, in cold gas spraying, the coating material is applied in powder form at high speed onto the surface which is to be coated, for which a process gas, heated to a few 100° C., is accelerated to supersonic speed by expansion in a laval nozzle and subsequently the powder particles are injected into the gas jet. These injected spray particles are accelerated here to such a high speed that contrary to other thermal spraying methods, they form a dense and at the same time securely adhering layer, even without a preceding surface fusion or fusion, on impact onto the substrate, i.e onto the surface which is to be coated. The kinetic energy at the moment of the impact of the spray particles onto the surface which is to be coated is not sufficient here, however, for a complete fusion of the spray particles. With cold gas spraying, the thermally conductive layer according to the invention can be applied economically and in a strongly adherent manner. In addition, the cold gas spraying offers the great advantage that it concerns a purely kinetic or respectively mechanical coating method, wherein no heat is brought into the workpiece which is to be coated. The coating can also be applied without the risk of oxide formation that occurs in alternative coating methods, which is particularly advantageous because an oxide layer has a distinctly poorer thermal conductivity than the thermally conductive coating of pure material.

An alternative thermal spraying method is, for example, plasma spraying, in which an anode and up to three cathodes are separated from one another by a narrow gap on a plasma torch. An arc is produced here between anode and cathode by a direct current, wherein the gas flowing through the plasma torch is directed through the arc and is ionized here. The dissociation, or respectively subsequent ionisation, produces a highly heated electrically conductive gas of positive ions and electrons, in which the coating material is injected and is immediately fused by the high plasma temperature. The plasma stream, in so doing, entrains the coating material and throws the latter onto the surface which is to be coated.

Of course, in all the mentioned thermal spraying methods, before the application of the actual thermally conductive coating also an adhesion base can be applied, which has for example aluminium and/or nickel. Such an adhesion base can be up to 100 μm thick here.

Generally, the thermally conductive coating applied according to the invention by means of a thermal spraying method can be used not only for composite pistons, but also for one-piece pistons and Otto pistons. The great advantage of the thermal spraying, in particular of the cold gas spraying, for the spraying on of the thermally conductive coating is the high degree of economy here and the heat removal optimized by the thermally conductive coating as a consequence of the high power density, in particular in applications in passenger cars. With the cold gas spraying, the thermally conductive coating can be applied purely mechanically, without separate energy input, whereby the risk of oxide formation, which reduces the thermal conductivity, can be ruled out.

Further important features and advantages of the invention will emerge from the subclaims, from the drawings and from the associated description of the figures with the aid of the drawings.

It shall be understood that the features mentioned above and to be explained in further detail below are able to be used not only in the respectively indicated combination, but also in other combinations or in isolation, without departing from the scope of the present invention.

Preferred example embodiments of the invention are represented in the drawings and are explained in further detail in the following description, wherein identical reference numbers refer to identical or similar or functionally identical components.

BRIEF DESCRIPTION OF THE DRAWINGS

There are shown here, respectively diagrammatically.

DETAILED DESCRIPTION

Figure 1:
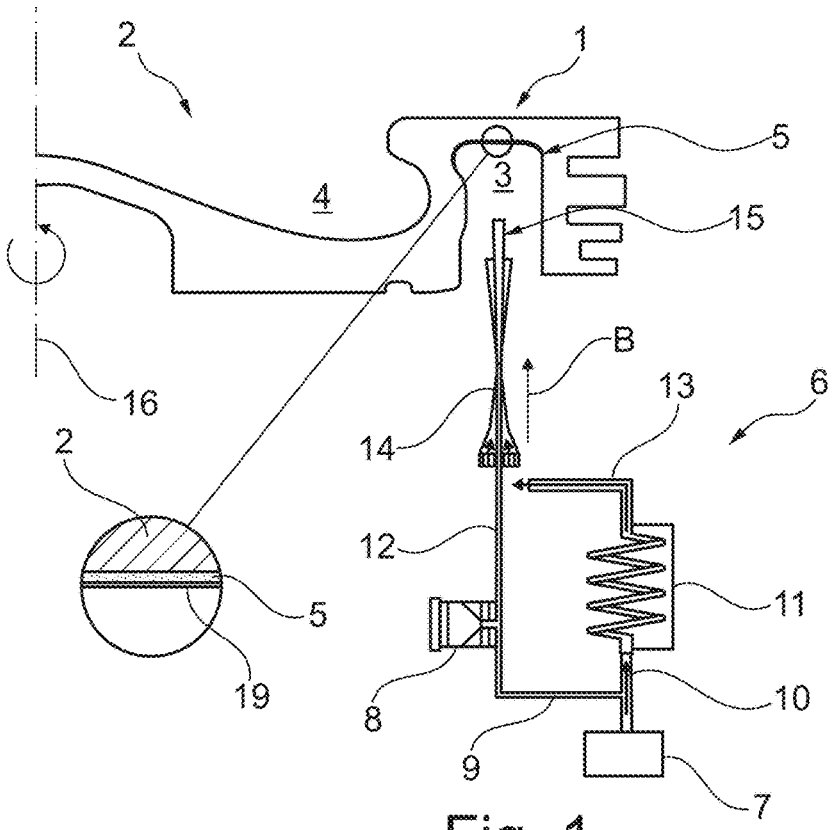
FIG. 1 a sectional illustration through a piston according to the invention during the spraying on of the thermally conductive coating according to the invention, FIG. 2 a piston, from below, coated by the spraying method according to the invention.

In accordance with FIG. 1 a piston upper part 1 of a piston 2 is illustrated, wherein a cooling duct 3 runs in the piston upper part 1. A region of the piston 2 on the crankshaft side, in the illustrated example embodiment a region of the cooling duct 3 facing a combustion chamber 4, is provided here with a thermally conductive coating 5 which is sprayed on by means of a thermal spraying method. Molten bath spraying, arc spraying, plasma spraying, flame spraying, detonation spraying, laser spraying or cold gas spraying come into consideration in particular here as thermal spraying method. Particularly with the last-mentioned cold gas spraying, a high process speed and thereby an economically advantageous implementation can be achieved within a production line.

The piston 2 can be embodied for example as a composite or as a one-part piston, and furthermore can be embodied from a ferrous material, in particular from steel. The thermally conductive coating 5, applied by means of the thermal method, in particular by means of the cold gas spraying, can have for example aluminium, silver and/or copper. A thermally conductive coating 5 of preferably pure copper proves to be particularly advantageous here with regard to thermal conductivity.

The thermally conductive coating 5 can have for example a thickness of 100 to 500 μm and can be produced from a powder having a grain size of up to 100 μm, preferably with a grain size of 15 μm to 25 μm. By the choice of the grain size between 15 and 25 μm, a particularly compact, dense and homogeneous thermally conductive coating 5 can be produced. The roughness Ra of the thermally conductive coating 5 can be varied for example in a range of 0.5 μm to 4.0 μm.

According to FIG. 1 furthermore a device 6 is shown for producing or respectively spraying on the thermally conductive coating 5, wherein the thermally conductive coating 5 can be applied both onto a finished piston and also onto a merely pre-processed piston 2. A separate cleaning of the surface which is to be coated before the spraying on of the thermally conductive coating 5 is not imperatively necessary.

The device 6 for cold gas spraying comprises in a manner known per se a storage container 7 for a gas, for example nitrogen, which serves both as process gas and also as carrier gas for the pulverulent material. The materials used in the example embodiment are stored in a powder conveyor 8, wherein a pipeline 9 runs from the storage container 7 to the powder conveyor 8. The gas transported via this pipeline 9 into the powder conveyor 8 serves as carrier gas for the pulverulent material, wherein a further pipeline 10 leads from the storage container 7 to a heater 11, in particular a gas heater. The gas transported into this heater 11 serves as process gas, which if required can be heated to a temperature of for example 200 to 600° C. Both the carrier gas with the pulverulent material and also the process gas are now transported via pipelines 12, 13 into a supersonic nozzle or laval nozzle 14. There, the powder-gas mixture is accelerated in the direction of the arrow B, therefore in the direction of the surface which is to be coated, i.e. in the example embodiment onto the inner wall of the cooling duct 3 to a speed of more than 500 m/s, in peaks up to 1500 m/s. The resulting jet 15 strikes at operating distances of typically 5 to 50 mm onto the surface which is to be coated and forms here the thermally conductive coating 5 in a defined thickness, of preferably 300 to 500 μm. The piston 2 usually rotates here about its central axis 16, wherein if required of course also a mask can be placed onto the surface which is to be coated, if only a partial coating is desired.

With the thermal spraying according to the invention, in particular with the cold gas spraying, so-called local hot spots can be avoided in the region of the piston upper part 1, and thereby a homogenising of the temperature distribution can be achieved. At the same time, an improved delivery of the heat occurring in the combustion chamber 4 can be achieved to cooled regions, for example to the cooling duct 3 or a corresponding spray-on cooling and thereby an improved heat removal can be achieved. The piston 2 according to the invention can be used here both as a composite or one-piece piston and also as a steel piston (both Otto and diesel). Through the cold gas spraying, a high process speed can be achieved, whereby an economically advantageous implementation is possible within the production line. In cold gas spraying in addition, through the comparatively low temperatures, a subsequent thermal treatment can potentially be dispensed with.

Figure 2:
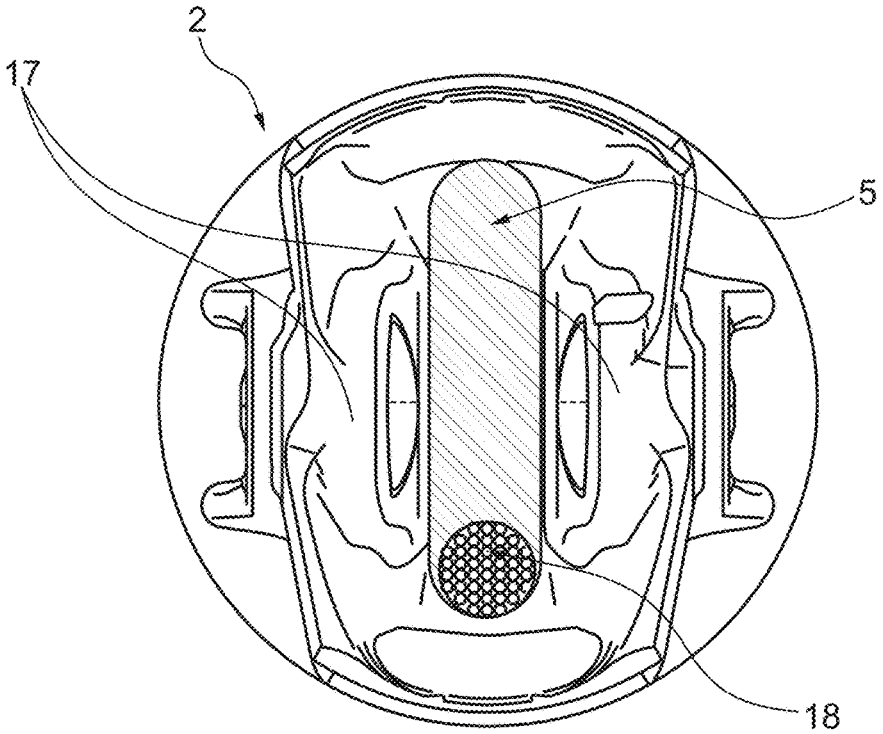

In FIG. 2 a further possibility of a thermally conductive coating 5 according to the invention on a piston 2 is illustrated. This concerns a "linear" coating of a piston underside between a hub 17 (via connecting rod) in order to conduct heat from the centre of the base to the spray-on cooling 18/cooling duct 3.

Generally, a protective layer 19 covering the thermally conductive coating 5 can be provided. Some examples for protective layers 19 are presented in the following table.

| Protective layer or respectively treatment | Application method | Layer thickness | Advantages/Disadvantages |
|---|---|---|---|
| Nickel | Galvanic | at least 5 μm, in order to be dense | Can be applied by immersion or if applicable in through-flow. Deposition rates of 5-30 μm/min or higher are possible. Unlimited bath durability. Normal care expenditure in baths. |
| Electroless Nickel (Ni—P) | External current-free, deposition takes place via a chemical redox mechanism | at least 5 μm, in order to be dense | Requires no forming anode coats surfaces true to contour and uniformly. Deposition rate max. 15 μm/h. Is applied almost only by immersion. Limited bath duration. Increased care expenditure in baths. |
| Chrome | Galvanic | at least 10 μm, in order to be dense, because cracks are almost always present in Cr layers. | Can be applied by immersion or if applicable in through-flow. Deposition rates ca. 1 μm/min. by immersion, in simple through-flow up to ca. 4-5 μm/min. Limitless bath durability. Higher care expenditure in baths. |
| Silver | Galvanic | at least 5 μm, in order to be dense | Is applied by immersion. Deposition rates distinctly below 1 μm/min. Generally, cyanidic baths are used. Cyanide-free baths have an even lower deposition rate. Limited bath durability. Higher care expenditure in baths. |
| Silver | External current-free. Deposition takes place via a chemical redox mechanism | at least 5 μm, in order to be dense | Requires no forming anode coats surfaces true to contour and uniformly/regions which are not to be coated are to be covered, if applicable. Almost always, hot cyanidic baths are used with special additives. Is only applied by immersion. Deposition rate distinctly below 1 μm/min. Limited bath durability. Increased care expenditure in baths. |
| Tin | only galvanically possible on iron, currentless on aluminium. | at least 5 μm, in order to be dense, becomes difficult with aluminium. | Galvanic: Anode (as far as possible true to shape) necessary, Currentless: non-coated regions must be covered. Both methods only by immersion. Melting point tin <240° C. Deposition rate galvanic ca. 1-5 μm/min., currentless ca. 1 μm/min. Limitless bath durability and low care expenditure. |
| Sulphidising Copper (liver of sulphur) | chemical process | unknown, as no experience concerning denseness | Either via a reaction of $H_2S$ gas (toxic!) with copper or via immersion in solutions containing polysulphides, sulphides and additives. Odour nuisance. Deposition rate not known. |

This protective layer 19 prevents a direct contact between the oil cooling the piston 2 and the copper coating and therefore reduces the risk of degradation of the oil. The protective layer 19 is configured here so as to be acting non-catalytically and in particular has at least one of the following components, nickel, chrome, silver, tin. Alternatively, the protective layer 19 can also be treated with liver of sulphur, whereby a blackish, likewise non-catalytically acting coating is produced. The protective layer 19 can be configured to be thin and only has to be dense, so that already a thickness of 5-10 μm comes into consideration.

The metals named in the table can also be applied via various spraying methods (APS, Arc Wire Spraying, HVOF, cold gas spraying etc.). The high deposition rates are an advantage: A disadvantage are possibly the high overspray rates, which inevitably always lead to coverings. By these methods other metals can also be applied which are not precipitable from aqueous solutions or only with hydrogen embrittlement (zinc) and would possibly be of interest with regard to costs, such as e.g. aluminium, zinc, etc.

The invention claimed is:

1. A piston for an internal combustion engine, comprising: a surface of a metal piston part in a region on a crankshaft side including a thermally conductive coating disposed on the surface via cold gas spraying, wherein the thermally conductive coating is secured to the surface via a mechanical adhesive bond without heat modification to the piston part; and an adhesion layer disposed on the surface to provide an adhesive base for receiving the thermally conductive coating, the adhesion layer including at least one of aluminium and nickel;

wherein the thermally conductive coating is disposed on the surface between a hub and a combustion chamber, and the thermally conductive coating extends along a linear path to conduct heat from a centre region towards an annular cooling duct.

2. The piston according to claim 1, wherein the piston part includes steel.

3. The piston according to claim 1, wherein the piston is configured as a composite or as a one-piece piston.

4. The piston according to claim 1, wherein the thermally conductive coating has at least one of aluminium, silver and copper.

5. The piston according to claim 1, wherein the thermally conductive coating is produced from a powder having a grain size of 15 μm to 25 μm.

6. The piston according to claim 1, wherein the thermally conductive coating has a thickness of 100-500 μm, and wherein the thermally conductive coating includes a homogenous composition of a pure metal.

7. The piston according to claim 1, wherein the thermally conductive coating includes a roughness Ra of 0.5 μm to 4.0 μm.

8. The piston according to claim 1, further comprising a protective layer covering the thermally conductive coating.

9. The piston according to claim 8, wherein at least one of:

the protective layer is configured to be acting non-catalytically and includes at least one of nickel, chrome, silver, and tin, and the protective layer is treated with liver of sulphur.

10. The piston according to claim 8, wherein the protective layer has a thickness of 5-10 μm.

11. The piston according to claim 8, wherein the protective layer is configured to be acting non-catalytically and includes a galvanic immersion deposited material or a currentless immersion deposited material.

12. A method of manufacturing a piston, comprising:

producing a thermally conductive coating from a powder having a grain size of 15 μm to 25 μm; and applying the thermally conductive coating to a surface of a metal piston part in a region on a crankshaft side via cold gas spraying, wherein the thermally conductive coating includes at least one of aluminium, silver and copper, and defines a roughness Ra of 0.5 μm to 4.0 μm; and covering the thermally conductive coating via a protective layer, wherein at least one of: (i) the protective layer is configured to act non-catalytically and includes at least one of nickel, chrome, silver and tin applied via galvanic deposition by immersion or includes at least one of nickel, silver and tin applied via currentless deposition by immersion and (ii) the protective layer undergoes a treating step with liver of sulphur.

13. The method according to claim 12, wherein applying the thermally conductive coating to the surface of the metal piston part forms a mechanical adhesive bond between the thermally conductive coating and the surface without heat modification to the metallurgy of the piston part.

14. The method according to claim 12, wherein the thermally conductive coating includes a homogeneous composition of a pure metal, the pure metal including one of aluminium, silver and copper, and wherein the thermally conductive coating further includes a thickness of 100 μm to 500 μm.

15. A piston for an internal combustion engine, comprising:

a metallic upper part having an outer surface facing a combustion chamber and an inner surface facing a direction of a crankshaft;

a thermally conductive coating disposed on the inner surface via cold gas spraying, the thermally conductive coating including at least one of aluminium, silver and copper, and wherein the thermally conductive coating is secured to the surface via a mechanical adhesive bond without heat modification to the metallurgy of the upper part;

a protective layer overlaying the thermally conductive coating, wherein the protective layer at least one of (i) includes a non-catalytic composition, and (ii) is sulphurized;

wherein the non-catalytic composition includes a galvanic immersion deposited material or a currentless immersion deposited material; and wherein the thermally conductive coating is disposed on the inner surface between a hub and the combustion chamber, and the thermally conductive coating extends along a linear path to conduct heat from a centre region towards an annular cooling duct.

16. The piston according to claim 15, wherein the thermally conductive coating is formed from a powder including a grain size of 15 μm to 25 μm.

17. The piston according to claim 15, wherein the thermally conductive coating includes a homogeneous composition of a pure metal, the pure metal including one of aluminium, silver and copper, and wherein the thermally conductive coating further includes a thickness of 100 μm to 500 μm.

* * * * *